US006135900A

United States Patent [19]

McGrath

[11] Patent Number: 6,135,900

[45] Date of Patent: Oct. 24, 2000

[54] BASEBALL AND SOFTBALL PRACTICE DEVICE

[76] Inventor: Joseph M. McGrath, 26 Woldbrook Dr., Windham, Me. 04062-5359

[21] Appl. No.: 09/097,982

[22] Filed: Jun. 16, 1998

[51] Int. Cl.[7] ..... A63B 69/00

[52] U.S. Cl. ..... 473/454; 473/423; 473/473; 273/317.6

[58] Field of Search ..... 473/454, 415, 473/421–422, 460, 462, 478, 594, 435, 197; 273/402, 407, 317.6

[56] References Cited

U.S. PATENT DOCUMENTS

| | | | |
|---|---|---|---|
| 392,565 | 11/1888 | Larew . | |
| 2,922,653 | 1/1960 | O'Brien | 473/197 |
| 2,932,516 | 4/1960 | Penner | 273/402 |
| 3,001,795 | 9/1961 | Johnson, Jr. | 473/421 |
| 4,036,465 | 7/1977 | Kellner . | |
| 4,092,023 | 5/1978 | Hazen | 473/454 |
| 4,097,044 | 6/1978 | Miniere | 473/451 |
| 4,364,562 | 12/1982 | White et al. | 473/435 |
| 4,395,042 | 7/1983 | Boswell | 473/197 |
| 4,955,607 | 9/1990 | Maye | 473/456 |
| 4,969,651 | 11/1990 | Comartin | 473/421 |
| 5,332,230 | 7/1994 | Benedict | 273/402 |
| 5,433,434 | 7/1995 | Helmetsie | 473/446 |
| 5,738,599 | 4/1998 | Malwitz | 473/423 |

*Primary Examiner*—Jeanette Chapman
*Assistant Examiner*—Mitra Aryanpour

[57] ABSTRACT

A new baseball and softball practice device for improving a ball player's skills in pitching, throwing, and hitting. The inventive device includes a length of protective nylon netting. A support frame is provided that is comprised of a pair of opposed folding legs. The support fame includes a top panel and a pair of lower support panels. The support frame is positionable in front of the protective nylon netting. A target is secured between the pair of opposed folding legs of the support frame.

1 Claim, 2 Drawing Sheets

BASEBALL AND SOFTBALL PRACTICE DEVICE

BACKGROUND OF THE INVENTION

1. Field of the Invention

The present invention relates to baseball pitching targets and more particularly pertains to a new baseball and softball practice device for improving a ball player's skills in pitching, throwing, and hitting.

2. Description of the Prior Art

The use of baseball pitching targets is known in the prior art. More specifically, baseball pitching targets heretofore devised and utilized are known to consist basically of familiar, expected and obvious structural configurations, notwithstanding the myriad of designs encompassed by the crowded prior art which have been developed for the fulfillment of countless objectives and requirements.

Known prior art baseball pitching targets include U.S. Pat. No. 4,643,423 to Wright; U.S. Pat. No. 4,497,485 to Macosko; U.S. Pat. No. 4,955,607 to Maye; U.S. Pat. No. 4,295,648 to Stromback; U.S. Pat. No. 4,629,188 to Mahieu; and U.S. Pat. No. Des. 350,569 to Boteler.

While these devices fulfill their respective, particular objectives and requirements, the aforementioned patents do not disclose a new baseball and softball practice device. The inventive device includes a length of protective nylon netting. A support frame is provided that is comprised of a pair of opposed folding legs. The support fame includes a top panel and a pair of lower support panels. The support frame is positionable in front of the protective nylon netting. A target is secured between the pair of opposed folding legs of the support frame.

In these respects, the baseball and softball practice device according to the present invention substantially departs from the conventional concepts and designs of the prior art, and in so doing provides an apparatus primarily developed for the purpose of improving a ball player's skills in pitching, throwing, and hitting.

SUMMARY OF THE INVENTION

In view of the foregoing disadvantages inherent in the known types of baseball pitching targets now present in the prior art, the present invention provides a new baseball and softball practice device construction wherein the same can be utilized for improving a ball player's skills in pitching, throwing, and hitting.

The general purpose of the present invention, which will be described subsequently in greater detail, is to provide a new baseball and softball practice device apparatus and method which has many of the advantages of the baseball pitching targets mentioned heretofore and many novel features that result in a new baseball and softball practice device which is not anticipated, rendered obvious, suggested, or even implied by any of the prior art baseball pitching targets, either alone or in any combination thereof.

To attain this, the present invention generally comprises a length of protective nylon netting. The netting has opposite ends secured to elongated poles. The elongated poles each have a weighted base secured to free lower ends thereof. Free upper ends of the poles each have a tie down line extending outwardly therefrom. The tie down lines each have stakes disposed on free ends for penetrating a ground surface. A support frame is provided that is comprised of a pair of opposed folding legs. The support frame includes a top panel and a pair of lower support panels. The support frame is positionable in front of the protective nylon netting. A target is secured between the pair of opposed folding legs of the support frame. The target is comprised of a circular tire.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new baseball and softball practice device apparatus and method which has many of the advantages of the baseball pitching targets mentioned heretofore and many novel features that result in a new baseball and softball practice device which is not anticipated, rendered obvious, suggested, or even implied by any of the prior art baseball pitching targets, either alone or in any combination thereof.

It is another object of the present invention to provide a new baseball and softball practice device which may be easily and efficiently manufactured and marketed.

It is a further object of the present invention to provide a new baseball and softball practice device which is of a durable and reliable construction.

An even further object of the present invention is to provide a new baseball and softball practice device which is susceptible of a low cost of manufacture with regard to both materials and labor, and which accordingly is then susceptible of low prices of sale to the consuming public, thereby making such baseball and softball practice device economically available to the buying public.

Still yet another object of the present invention is to provide a new baseball and softball practice device which provides in the apparatuses and methods of the prior art some of the advantages thereof, while simultaneously overcoming some of the disadvantages normally associated therewith.

Still another object of the present invention is to provide a new baseball and softball practice device for improving a ball player's skills in pitching, throwing, and hitting.

Yet another object of the present invention is to provide a new baseball and softball practice device which includes a length of protective nylon netting. A support frame is provided that is comprised of a pair of opposed folding legs. The support fame includes a top panel and a pair of lower support panels. The support frame is positionable in front of the protective nylon netting. A target is secured between the pair of opposed folding legs of the support frame.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
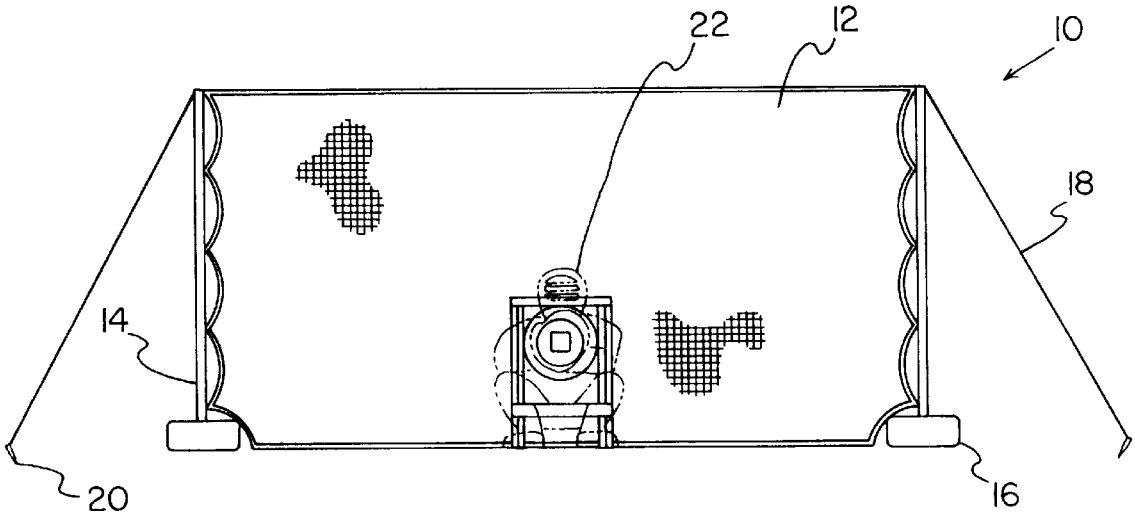
FIG. 1 is a front view of a new baseball and softball practice device according to the present invention.

With reference now to the drawings, and in particular to FIGS. 1 through 4 thereof, a new baseball and softball practice device embodying the principles and concepts of the present invention and generally designated by the reference numeral 10 will be described.

As best illustrated in FIGS. 1 through 4, the baseball and softball practice system 10 comprises a length of protective nylon netting 12. The netting 12, a support frame 24, and a target 32 has opposite ends secured to elongated poles 14. The elongated poles 14 each have a weighted base 16 secured to free lower ends thereof. Free upper ends of the poles 14 each have a tie down line 18 extending outwardly therefrom. The tie down lines 18 each have stakes 20 disposed on free ends for penetrating a ground surface. The weighted bases 16 and the tie down lines 18 serve to stabilize the netting 12. Optionally, the netting 12 could have a picture of a catcher 22 thereon to contribute to the realism of the present invention.

A support frame 24 is provided that is comprised of a pair of opposed folding legs 26. The support frame 24 includes a top panel 28 and a pair of lower support panels 30. The support frame 24 is positionable in front of the protective nylon netting 12. The support frame 24 can be collapsed for easy storage.

Figure 2:
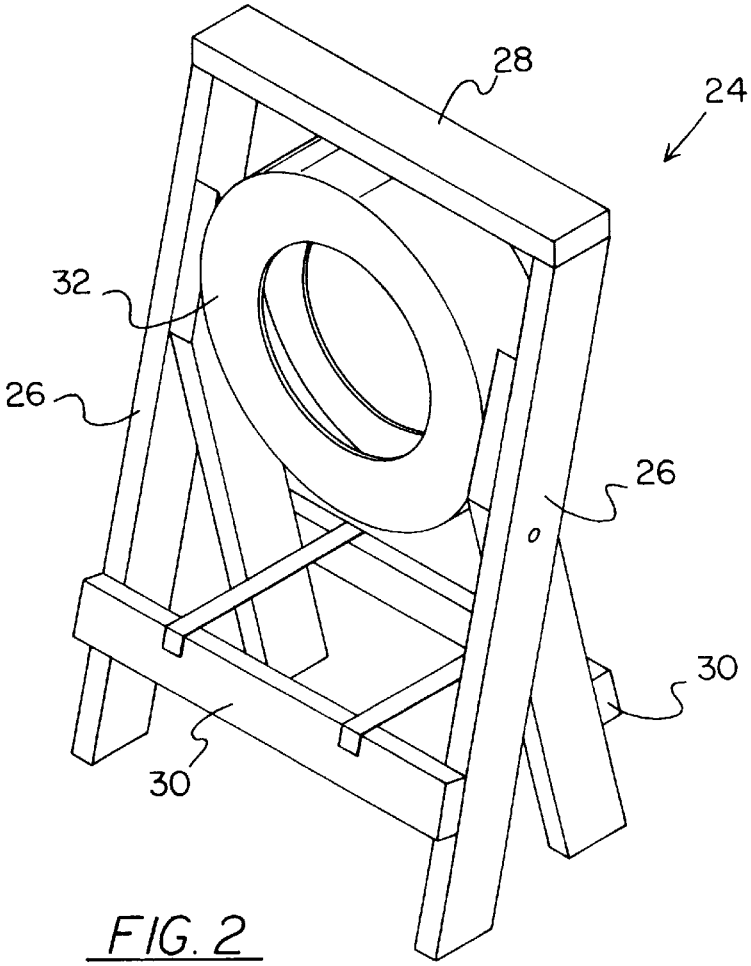
FIG. 2 is a perspective view of the tire target and support frame of the present invention.
Figure 3:
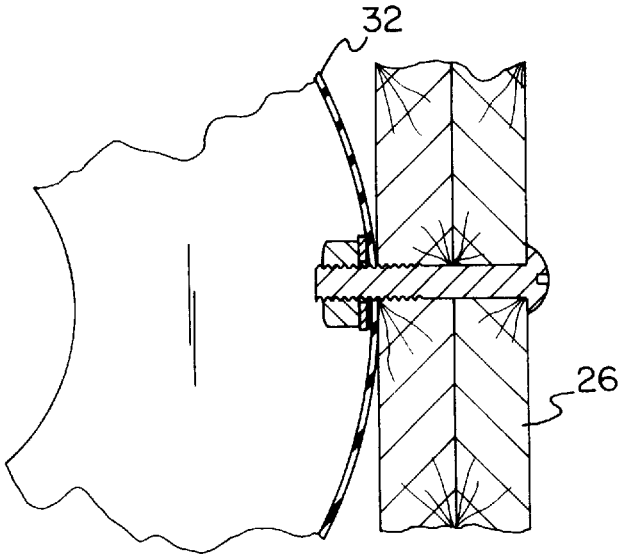
FIG. 3 is a cross-sectional view of the present invention illustrating the securement of the tire target to the support frame.

In more detail, the support frame has a first pair of legs and a second pair of legs (see FIG. 2). The first pair of legs are laterally spaced and substantially rigidly connected by the top panel 28 and a first lower support panel 30. The top panel is mounted to upper ends of the first pair of legs 26. The first lower panel is mounted to the first pair of legs at a location spaced from lower ends of the first pair of legs. The second pair of legs is laterally spaced and substantially rigidly connected by a second lower panel. The second lower panel is mounted to the second pair of legs at a location spaced upwardly from lower ends of the second pair of legs. The second pair of legs each have an upper end, and each of the upper ends of the second pair of legs is pivotally coupled to one of the first pair of legs to permit pivoting of the second pair of legs may be pivoted into a nested position between the first pair of legs for permitting a more compact storage configuration. The support frame includes a pair of straps extending between the first and second lower support panels to limit the pivot movement of the second pair of legs with respect to the first pair of legs.

Figure 4:
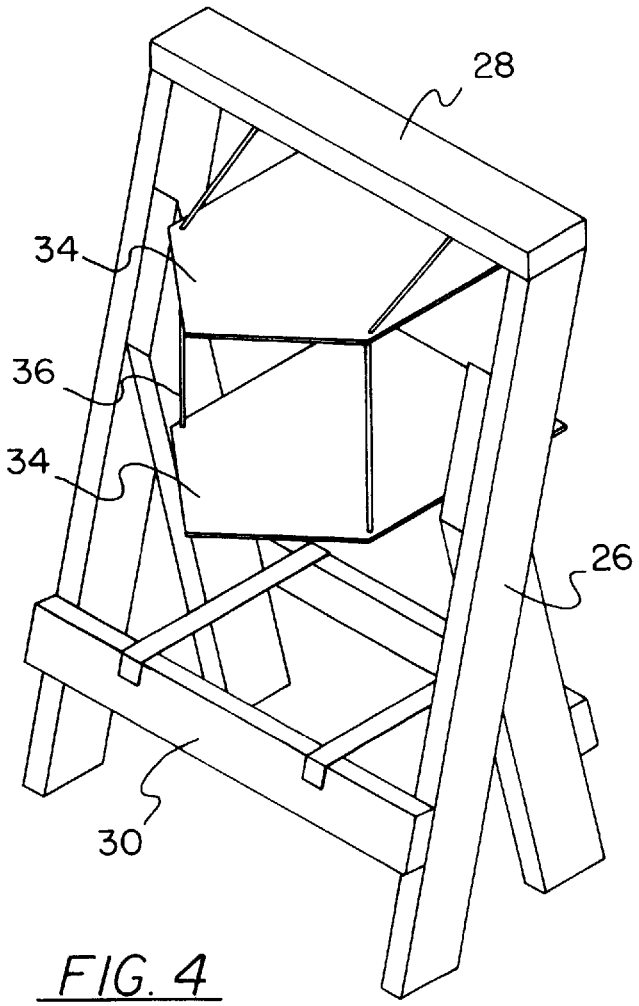
FIG. 4 is a perspective view of the present invention illustrating an alternate target shown secured to the support frame.

A target 32 is secured between the pair of opposed folding legs 26 of the support frame 24. The target 32 is comprised of a circular tire. The target 32 is used for a ball to be thrown therethrough to gauge a player's ability to accurately throw or pitch. An alternate target is illustrated in FIG. 4. This target is comprised of a pair of horizontally disposed plates 34 in a spaced relationship. The plates 34 are adjustable through the use of strings 36 extending therethrough and coupling with the support frame 24. The strings 36 allow the space between the plates 34 to be varied. The space between the plates 34 represents a strike zone for a pitched ball.

In use, the present invention is a product that would help a baseball or softball player improve his/her skills. The present invention would allow a baseball or softball player to practice and improve his/her pitching, throwing, and hitting.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A baseball and softball practice system for improving a ball player's skills comprising, in combination:

a length of protective nylon netting, the netting having opposite ends secured to elongated poles, the elongated poles each having a weighted base secured to free lower ends thereof, free upper ends of the poles having a tie down line extending outwardly therefrom, the tie down lines each having stakes disposed on free ends for penetrating a ground surface;

a collapsible support frame adapted for placement on a ground surface in front of the protective nylon netting, the support frame having a first pair of legs and a second pair of legs, the first pair of legs being laterally spaced and substantially rigidly connected by a top panel and a first lower support panel, the top panel being mounted to upper ends of the first pair of legs, the first lower panel being mounted to the first pair of legs at a location spaced from lower ends of the first pair of legs, the second pair of legs being laterally spaced and substantially rigidly connected by a second lower panel, the second lower panel being mounted to the second pair of legs at a location spaced upwardly from lower ends of the second pair of legs, the second pair of legs each having an upper end, each of the upper ends of the second pair of legs being pivotally coupled to one of the first pair of legs to permit pivoting of the second pair of legs with respect to the first pair of legs, the second pair of legs being positioned between the first pair of legs so that the second pair of legs may be pivoted into a nested position between the first pair of legs for permitting a more compact storage configuration, the support frame including a pair of straps extending between the first and second lower support panels to limit the pivot movement of the second pair of legs with respect to the first pair of legs;

a target secured between the first and second pair of legs of the support frame, the target being pivotally coupled to the first and second pair of legs, the target having a passage therein representing a strike zone for an accurately thrown ball to pass through, the target being comprised of a circular tire.

* * * * *